US010111316B1

(12) United States Patent
Simakov et al.

(10) Patent No.: US 10,111,316 B1
(45) Date of Patent: Oct. 23, 2018

(54) PHOTONIC BAND GAP ACCELERATOR

(71) Applicant: LOS ALAMOS NATIONAL SECURITY, LLC, Los Alamos, NM (US)

(72) Inventors: Evgenya Simakov, Los Alamos, NM (US); Dmitry Shchegolkov, Los Alamos, NM (US)

(73) Assignee: Los Alamos National Security, LLC, Los Alamos, NM (US)

( * ) Notice: Subject to any disclaimer, the term of this patent is extended or adjusted under 35 U.S.C. 154(b) by 0 days.

(21) Appl. No.: 15/376,307

(22) Filed: Dec. 12, 2016

Related U.S. Application Data

(60) Provisional application No. 62/320,330, filed on Apr. 8, 2016.

(51) Int. Cl.

| | |
|---|---|
| ***H05H 9/00*** | (2006.01) |
| ***H05H 7/00*** | (2006.01) |
| ***H01P 1/20*** | (2006.01) |
| ***H05H 7/22*** | (2006.01) |

(52) U.S. Cl.
CPC ..... *H05H 9/00* (2013.01); *H01P 1/2005* (2013.01); *H05H 7/22* (2013.01)

(58) Field of Classification Search
CPC .. H05H 1/00; H05H 7/00; H05H 9/00; H05H 11/00; H05H 13/00; H05H 15/00; H05H 7/22; H01P 1/2005; H01S 3/061
USPC ..... 315/111.01–111.91, 500–507
See application file for complete search history.

(56) References Cited

PUBLICATIONS

Simakov, Optimizing the configuration of a superconducting photonic band gap accelerator cavity to increase the maximum achievable gradients [online], Feb. 2014, [retrieved on Dec. 27, 2017]. Retrieved from internet: <URL: https://journals.aps.org/prab/abstract/10.1103/PhysReySTAB.17.022001> [Phys. Rev. ST Accel. Beams 17, 022001].*
Evgenya I. Simakov et al., Observation of Wakefield Suppression in a Photonic-Band-Gap Accelerator Structure, Physical Review Letters, PRL 116, 064801, Feb. 12, 2016, © 2016 American Physical Society, 5 pages.

(Continued)

*Primary Examiner* — Tung X Le
*Assistant Examiner* — Henry Luong
(74) *Attorney, Agent, or Firm* — Lewis Roca Rothgerber Christie LLP

(57) ABSTRACT

A preferred compact particle accelerator can include a cell arranged along a longitudinal axis along which a particle beam is accelerated. The preferred cell can include a first plate disposed substantially orthogonal to the longitudinal axis and a second plate disposed substantially parallel to the first plate. The preferred cell can also include a first set of rods connecting the first plate to the second plate and disposed at a first radius about the longitudinal axis. Preferably, the first set of rods each defines an elliptical cross section. The preferred cell can also include a second set of rods connecting the first plate to the second plate and each disposed at least at a second radius greater than the first radius. Optimized geometry of the elliptical rods and the periodicity of the rods in the lattice provide improved wakefield suppression and allow for significant gains in frequency and output.

20 Claims, 6 Drawing Sheets
(3 of 6 Drawing Sheet(s) Filed in Color)

(56) References Cited

PUBLICATIONS

Evgenya I. Simakov et al., "Raising gradient limitations in 2.1 GHz superconducting photonic band gap accelerator cavities," Applied Physics Letters, 104, 242603 (2014), © AIP Publishing LLC, 5 pages.

Evgenya I. Simakov et al., "Optimizing the configuration of a superconducting photonic band gap accelerator cavity to increase the maximum achievable gradients," Physical Review Special Topics—Accelerators and Beams, 17, 022001 (2014), Published by the American Physical Society, 7 pages.

Brian J. Munroe et al., "High power breakdown testing of a photonic band-gap accelerator structure with elliptical rods," Physical Review Special Topics—Accelerators and Beams, 16, 012005 (2013), Published by the American Physical Society, 13 pages.

Roark a. Marsh, "X-Band photonic band-gap accelerator structure breakdown experiment," Physical Review Special Topics—Accelerators and Beams, 14, 021301 (2011), © 2011 American Physical Society, 11 pages.

Roark A. Marsh et al., "Measurement of wakefields in a 17 GHz photonic bandgap accelerator structure," Nuclear Instruments and Methods in Physics Research A, 618 (2010), Elsevier, pp. 16-21.

Evgenya I. Smirnova et al., Fabrication and cold test of photonic band gap resonators and accelerator structures, Physical Review Special Topics—Accelerators and Beams, 8, 091302 (2005), © The American Physical Society, 9 pages.

Evgenya I. Smirnova et al., "Demonstration of a 17-GHz, High-Gradient Accelerator with a Photonic-Band-Gap Structure," Physical Review Letters, PRL 95, 074801, Aug. 12, 2005, © 2005 The American Physical Society, 4 pages.

* cited by examiner

PHOTONIC BAND GAP ACCELERATOR

CROSS-REFERENCE TO RELATED APPLICATION

This utility patent application claims priority to and the benefit of U.S. Provisional Patent Application Ser. No. 62/320,330, filed Apr. 8, 2016 and entitled X-BAND PHOTONIC BAND GAP ACCELERATOR CELL WITH ELLIPTICAL RODS AND IMPROVED WAKEFIELDS SUPPRESSION, the entire content, of which is incorporated herein by reference.

GOVERNMENT RIGHTS STATEMENT

The present invention was made with government support under Contract No. DE-AC52-06NA25396 awarded by the U.S. Department of Energy/National Nuclear Security Administration to Los Alamos National Security, LLC for the operation of Los Alamos National Laboratory. The government has certain rights in the invention.

TECHNICAL FIELD

The present invention relates generally to the field of particle accelerators, and in particular to the field of photonic band gap particle accelerator cells and accelerators constructed therefrom.

BACKGROUND

There is an ever increasing need to reduce the size, weight, cost and complexity of particle accelerators in applications beyond the usual high-energy physics, nuclear physics and synchrotron light sources where the accelerator designs have been largely based on the traditional large, complex, high-voltage, high-gradient designs. As the use of particle beams becomes more diversified and commonplace, the limitations inherent within prior legacy designs are becoming more evident. In the medical field, for example, the availability of accelerators that can be used for imaging or therapeutic purposes is limited by their size and cast, and operational characteristics, such as whether the accelerator is a cyclotron or a LINAC, power consumption (typically in the MW level) and cooling requirements (water cooling towers or liquid helium refrigerators). As such, these accelerators tend to be located in communities and facilities that can support these constraints, such as major accelerator complexes with access to high-voltage electrical equipment, high-volume water cooling systems and/or helium refrigeration, major hospitals or large irradiation facilities for food and mail sterilization. In particular, medical applications of accelerators have been predominantly on the use of electron accelerator for radiation cancer-treatment therapy, even though proton-beam therapy has been proven very efficacious in treating a variety of cancers. This is due to a $100M price tag for each proton accelerator (either a cyclotron or a synchrotron) and the proton beam delivering gantry system. As a result, only a handful of hospitals in the US offer their patients the proton beam therapy option. Unfortunately, the need for advanced care far exceeds the ability to provide it for those communities most in need. Most of the world's population does not reside near a hospital with particle beam therapy based on traditional accelerator designs, thus that population is denied the most advanced medical care available.

Aside from the delivery of advanced medical care, accelerators are used in energy and environmental research. For example, powerful x-ray beams produced by accelerators help scientists analyze protein structures, enabling them to develop new drugs designed to treat diseases such as cancer, diabetes, malaria, and even AIDS. In the areas of environmental safety and stewardship, blasts of electrons from an accelerator can effectively clean up dirty water, sewage sludge, and polluted gases from smokestacks. The same particles can be used to kill bacteria to prevent foodborne illnesses. Industry uses accelerator technology to implant ions in silicon chips. Such chips are used in many electronic products, such as computers, smart phones, and MP3 players. One final example of the utility of the field of the present invention is that particle accelerators can treat nuclear waste and enable the use of an alternative fuel, thorium, to produce green nuclear energy.

Advanced accelerator research is concerned with developing machines that can generate greater intensities, higher power, superior reliability, and enhanced efficiency. Concurrently, such accelerators must be designed so that they are more compact (smaller) and more cost-effective. Creating a more compact and cost-effective accelerator requires the ability to achieve high accelerating gradients in higher-frequency accelerating structures. The principal roadblock in such development is that at such high frequencies higher-order modes (parasitic, high-frequency oscillations of the accelerator structure) become excited by the very particle beam that propagates through the accelerating structure. These higher-order modes, or HOMs, interact with the accelerating beam, deteriorating its quality and intensity.

Accordingly, there is a need in the art for a compact and robust particle accelerator that can erase the structural and operational constraints on the design and delivery of high quality particle beams to be used in at least any of the aforementioned fields.

SUMMARY

In general a preferred particle accelerator includes a series of resonators or cells that function to focus and increase the kinetic energy of a particle beam passing there through. A resonator or cell can include a periodic lattice that includes of metal rods to create a patchwork three dimensional space within which certain wavelengths can resonate. The physical principle is also employed in optical photonic crystals to manipulate photons and prevent light of certain wavelengths from propagating through the structure. This range of forbidden wavelengths is what is known as a band gap, hence the term photonic band gap (PBG) accelerator.

Preferred PBG structures are designed so that the frequency of the accelerating mode falls in the band gap. The mode that accelerates the particle beam is trapped in a PBG resonator, which is formed by removing a rod from the PBG structure. Concurrently, the frequencies of the parasitic HOMs—that may be excited by the particle beam—fall outside the band gap. Thus, these HOMs propagate through the PBG structure toward the periphery, where they are successfully extracted and thus are prevented from damaging the accelerated beam.

As described in detail below, a preferred compact particle accelerator can include a cell arranged along a longitudinal axis along which a particle beam is accelerated. The preferred cell can include a first plate disposed substantially orthogonal to the longitudinal axis and a second plate disposed substantially parallel to the first plate. The preferred cell can also include a first set of rods connecting the first plate to the second plate and disposed at a first radius about the longitudinal axis. Preferably, the first set of rods each defines an elliptical cross section and a first periodicity there between. Preferably, the first set of rods is arranged such that the minor axis of each elliptical cross section is substantially parallel to an imaginary line emanating radially from the longitudinal axis.

The preferred cell can also include a second set of rods connecting the first plate to the second plate and each disposed at least at a second radius greater than the first radius. Preferably, the second set of rods each defining a circular cross section and a second periodicity there between. The geometry of the preferred cell is such that a ratio between the first periodicity and the second periodicity is between 0.9:1 and 1.1:1, a ratio between the minor axis and the second periodicity is between 1:9 and 1:12, and a ratio between the major axis and the second periodicity is between 1:3 and 1:5.

Other embodiments of the preferred cell can include a third set of rods connecting the first plate to the second plate. Preferably each of the third set of rods is disposed at least at a third radius greater than the second radius. Preferably each of the third set of rods each defines a circular cross section and a third periodicity there between. The geometry of the third set of rods is such that a ratio between the third periodicity and the second periodicity is between 1:1 and 1.1:1.

Additional features and advantages of the radiation generator of the preferred embodiment are described in detail below with reference to the following drawings.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE PREFERRED EMBODIMENTS

As described herein, a preferred photonic band gap accelerator and accelerator cell can provide a compact footprint and ease of use for a robust particle accelerator. In particular, the preferred accelerator cell configurations described herein provide ample gain to the particle beam while simultaneously suppressing potential higher order modes (HOMs) or wakefields that have traditionally caused interferences in photonic band gap accelerators. These and other features and advantages of the preferred photonic band gap accelerator and accelerator cell are illustrated below.

Preferred Embodiments

Figure 1A:
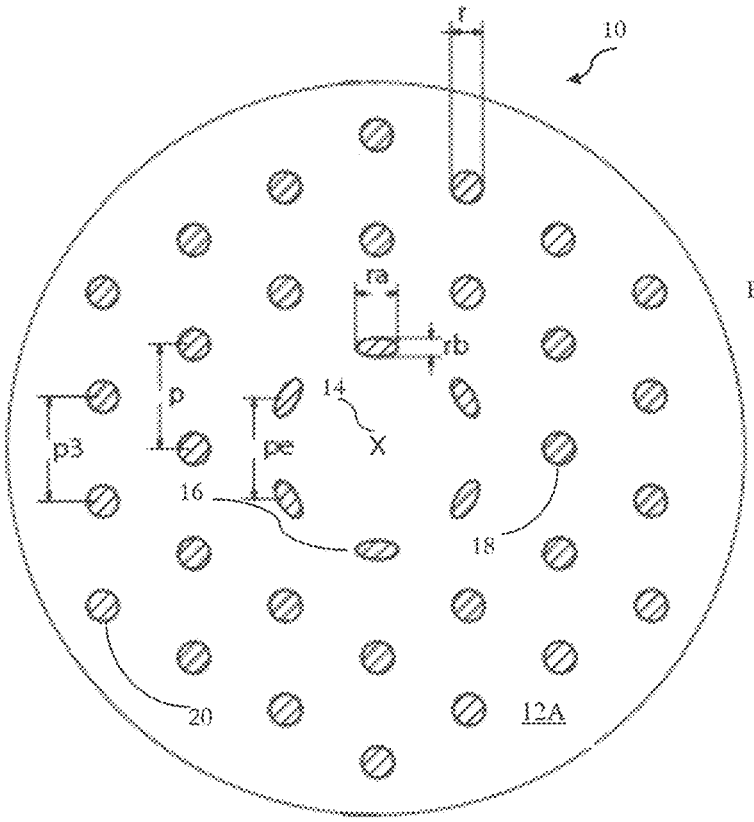
FIG. 1A is a cross-sectional view of a photonic band gap accelerator cell in accordance with a preferred embodiment of the present invention.
Figure 1B:
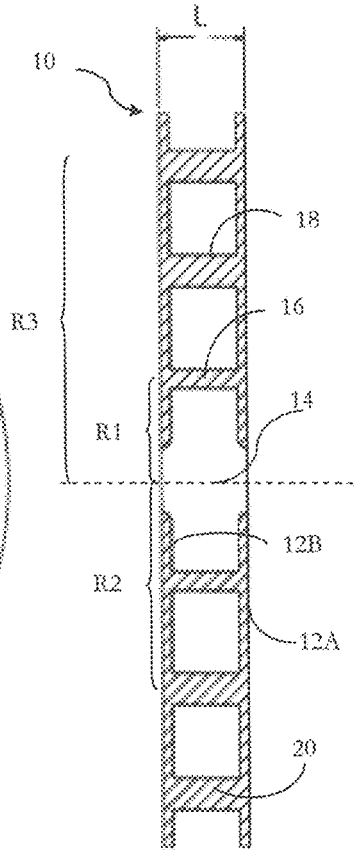
FIG. 1B is a side view of a photonic band gap accelerator cell in accordance with a preferred embodiment of the present invention.

As shown in FIGS. 1A and 1B, a particle accelerator cell 10 according to a preferred embodiment can be arranged along a longitudinal axis 14 along which a particle beam is accelerated. The preferred particle accelerator cell 10 can include a first plate 12A disposed substantially orthogonal to the longitudinal axis 14 and a second plate 12B disposed substantially parallel to the first plate 12A. As used herein the terms orthogonal and parallel should be understood to encompass a breadth of relative geometries subject to engineering tolerances prevalent in the design and construction of particle accelerators. The first plate 12A and the second plate 12B preferably function to define boundaries of a cell within which electromagnetic radiation can resonate and accelerate the particle beam; and further as boundaries that separate and/or define two or more cells disposed in series along the longitudinal axis 14 to define a particle accelerator. It will be appreciated by those of skill the art that when assembled into a particle accelerator, each cell has its own first plate 12A and its own second plate 12B. In alternative embodiments, the first plate 12A of one cell 10 can function as a second plate 12B in an adjacent cell 10; and further that a second plate 12B in another cell 10 can function as a first plate 12A in an adjacent cell 10. When disposed and/or constructed in series along the longitudinal axis 14, each of the preferred cells 10 function to accelerate the particle beam along the longitudinal axis 14 in a substantially additive manner, such that a total power output of the accelerator is a function of the number of cells 10 in the accelerator and the gain imparted by each cell 10.

As shown in FIGS. 1A and 1B, the preferred cell 10 can further include a first set of rods 16 connecting the first plate 12A to the second plate 12B. The first set of rods 16 preferably function to connect the first plate 12A and the second plate 12B to define the cell 10 as well as providing boundary conditions and wakefield suppression and/or modulation of the electromagnetic fields present along the longitudinal axis 14 during operation. As shown, the preferred first set of rods 16 are disposed at a first radius R1 about the longitudinal axis 14. Alternatively, the first set of rods 16 can be disposed at multiple radii and/or a range of radii from the longitudinal axis 14 depending upon the specific configuration and/or geometry of the cell 10. Preferably, the first set of rods 16 each defines an elliptical cross section and a first periodicity $p_e$ there between. As shown in FIGS. 1A and 1B, in a preferred accelerator the first set of rods 16 is arranged such that the minor axis $r_b$ of each elliptical cross section is substantially parallel to an imaginary line emanating radially from the longitudinal axis 14. Alternatively phrased, the first set of rods 16 is arranged such that the major axis $r_a$ of each elliptical cross section is substantially tangential to a circle drawn at the first radius R1. As described below, the preferred first set of rods 16 that define a particular ratio between the major and minor axes of each elliptical cross section.

As shown in FIGS. 1A and 1B, the preferred cell 10 can also include a second set of rods 18 connecting the first plate 12A to the second plate 12B. The second set of rods 18 preferably function to connect the first plate 12A and the second plate 12B to define the cell 10 as well as providing boundary conditions and wakefield suppression and/or modulation of the electromagnetic fields present along the longitudinal axis 14 during operation. As shown in FIGS. 1A and 1B, each of the second set of rods 18 is preferably substantially disposed at a second radius R2 greater than the first radius R1. As shown, the exact distance between each of the second set of rods 18 and the longitudinal axis 14 can vary depending upon the geometry and design of the cell 10, however the minimum radius of each of the second set of rods 18B is greater than R1. As shown for example, the second set of rods 18 is disposed in a substantially hexagonal matrix, thus each and every one of the second set of rods 18 is not equidistant from the longitudinal axis 14 just as each and every point along a hexagon is not equidistant from its center. In alternative embodiments, each of the first set of rods 16 and/or the second set of rods 18 is equidistant from adjacent rods in its set—i.e. the geometry of the respective matrices is regular and symmetrical about the longitudinal axis 14. However, for each of the second set of rods 18, a radial distance between the longitudinal axis 14 and the rod R2 is greater than R1. As shown, preferably each of the second set of rods 18 defines a circular cross section. As shown in FIGS. 1A and 1B, the second set of rods 18 also preferably defines and a second periodicity p there between.

The preferred geometry of the first set of rods 16 and the second set of rods 18 can be defined in terms of ratios between the various aspects and measures thereof. As used herein the term periodicity refers to a distance between a center point of a rod, whether elliptical or circular in cross-section, and the center point of an adjacent rod of the same type, i.e., the first set of rods 16 share a periodicity $p_e$ and the second set of rods share a periodicity p. Preferably, a ratio between the first periodicity $p_e$ and the second periodicity p is not 1:1, meaning that rods of differing types do not share the same periodicity. Alternatively, rods of differing types can have identical or substantially identical periodicities. In the cell 10 of the preferred embodiment, the ratio between the first periodicity $p_e$ and the second periodicity p is between 0.9:1 and 1.1:1. In one variation of the cell 10 of the preferred embodiment, the ratio between the first periodicity $p_e$ and the second periodicity p is between 0.95:1 and 1.05:1. In another variation of the cell 10 of the preferred embodiment, the ratio between the first periodicity $p_e$ and the second periodicity p is between 0.98:1 and 1:1. In still another variation of the cell 10 of the preferred embodiment, the ratio between the first periodicity $p_e$ and the second periodicity p is approximately 0.99:1.

Preferably, the cell 10 of the preferred embodiment further defines a ratio between the minor axis $r_b$ of each of the first set of rods 16 and the second periodicity p that is between 1:9 and 1:12 In a variation of the cell 10 of the preferred embodiment, the ratio between the minor axis $r_b$ and the second periodicity p is approximately 1:11. Preferably, the cell 10 of the preferred embodiment defines a ratio between the major axis $r_a$ and the second periodicity p between 1:3 and 1:5. In a variation of the cell 10 of the preferred embodiment, the ratio between the major axis $r_a$ and the second periodicity p is approximately 1:4. Those of skill in the art will therefore appreciate that there is a range of variations of preferred ratios of the major and minor axes ($r_a$:$r_b$) for the first set of rods 16. Preferred ratios of the major and minor axes ($r_a$:$r_b$) can range from 4:1 to 2:1. In one variation of the cell 10 of the preferred embodiment, the ratio of the major and minor axes ($r_a$:$r_b$) is approximately 25:9.

Preferably, the cell 10 of the preferred embodiment defines a ratio between a radius r of each of the second set of rods 18 and the second periodicity p that is between 1:8 and 1:6. As noted above, each of the second set of rods 18 preferably defines a substantially circular cross section and therefore a substantially uniform radius r perpendicular to the longitudinal axis 14. In one variation of the cell 10 of the preferred embodiment, the ratio between the radius r of each of the second set of rods 18 and the second periodicity is approximately 1:7, or 0.15:1. Those of skill in the art will therefore appreciate that there is a range of variations of the preferred ratios between the radii r of the second set of rods 18 and the radii (major and minor) of the first set of rods 16. In one particular configuration, the triple ratio $r_b$:r:$r_a$ can be expressed as a range between 7.5:15:30 and 10:15:20. In one example configuration described herein, the triple ratio $r_b$:r:$r_a$ is approximately 9:15:25.

As shown in FIGS. 1*a* and 1*b*, the preferred cell 10 can also include a third set of rods 20 connecting the first plate 12A to the second plate 12B. The third set of rods 20 preferably function to connect the first plate 12A and the second plate 12B to define the cell 10 as well as providing boundary conditions and wakefield suppression and/or modulation of the electromagnetic fields present along the longitudinal axis 14 during operation. As shown in FIGS. 1A and 1B, each of the third of rods 18 is preferably substantially disposed at a third radius R3 greater than the second radius R2, as defined above. As shown, the exact distance between each of the third set of rods 18 and the longitudinal axis 14 can vary depending upon the geometry and design of the cell 10, however the minimum radius of each of the third set of rods 20 is greater than R2, for all R2 as defined above. As shown for example, the third set of rods 20 is disposed in a substantially hexagonal matrix, thus each and every one of the third set of rods 20 is not equidistant from the longitudinal axis 14 just as each and every point along a hexagon is not equidistant from its center. In alternative embodiments, each of the first set of rods 16, the second set of rods 18, and/or the third set of rods 20 is equidistant from adjacent rods in its set—i.e. the geometry of the respective matrices is regular and symmetrical about the longitudinal axis 14. However, for each of the third set of rods 20, a radial distance between the longitudinal axis 14 and the rod R3 is greater than R2, which in turn is always greater than R1 as described above. As shown, preferably each of the third set of rods 20 also defines a circular cross section. As shown in FIGS. 1A and 1B, the third set of rods 20 also preferably defines and a third periodicity p3 there between.

The preferred cell 10 defines a ratio between the third periodicity p3 and the second periodicity p that is preferably between 1:1 and 1.1:1. In one variation of the preferred cell 10, the ratio between the third periodicity p3 and the second periodicity p is approximately 1.05:1. As noted above, the third set of rods 20 are preferably substantially circular in cross section, defining a radius r that is substantially equal to the radius r preferred in the second set of rods 18. As such, those of skill in the art will therefore appreciate that there is a range of variations of the preferred ratios between the radii r of the third set of rods 20 and the radii (major and minor) of the first set of rods 16. In one particular configuration noted above, the triple ratio $r_b$:r:$r_a$ can be expressed as a range between 7.5:15:30 and 10:15:20. In one example configuration described herein, the triple ratio $r_b$:r:$r_a$ is approximately 9:15:25.

Example Configurations

Those of skill in the art will appreciate that the preferred cell 10 can be configured in innumerable geometries within the preferred geometric ratios and variations thereof described above. The full impact and breadth of the present invention is defined solely by the appended claims, the following description of an example configuration is provided for illustrative purposes only and should not be construed as limiting in any manner.

The preferred cell 10 shown in FIGS. 1A and 1B can be configured for specific operation in a system or system of cells that function as a particle accelerator. One example accelerator has been designed with a series of cells 10 aligned along the longitudinal axis 14. In the example configuration a cell distance L between the first plate 12A and the second plate 12B (including the thickness of the plates 12A, 12B) is between 8 and 9 millimeters. In the example configuration, the major axis $r_a$ of each of the first set of rods 16 is approximately 2.58 millimeters, and the minor axis $r_b$ of each of the first set of rods 16 is approximately 0.93 millimeters. The first periodicity $p_e$ in the example configuration is approximately 10.22 millimeters. Further in the example configuration, the radius r of each of the second set of rods 18 and the third set of rods 20 is approximately 1.55 millimeters; and the second periodicity p is approximately 10.33 millimeters while the third periodicity p3 is approximately 10.85 millimeters. In operation, the example configuration receives an accelerating radiation at approximately 11.700 GHz (X-band) in a $2\pi/3$ accelerating mode. Those of skill in the art will readily appreciate that differing frequencies and/or accelerating modes can also be accommodated by the cell 10 of the preferred embodiment without departing from the spirit and scope of the claimed invention.

Figure 2:
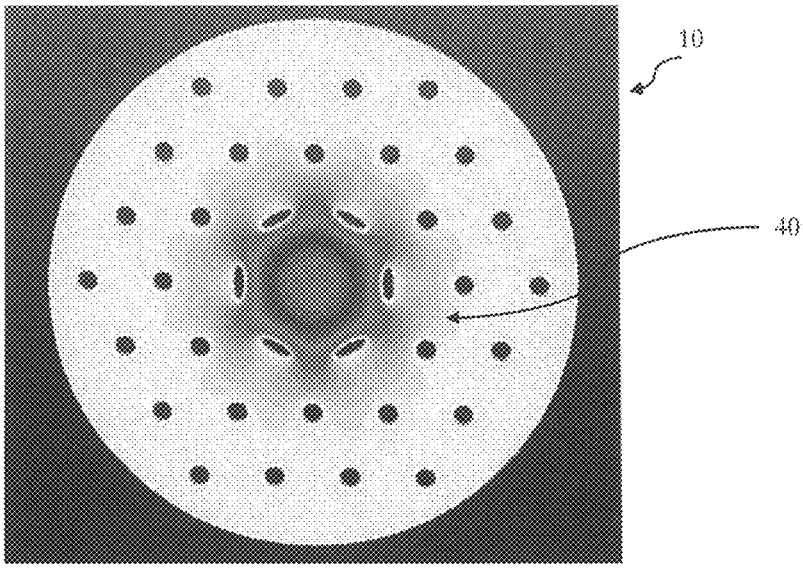
FIG. 2 is a simulated diagram of an electric field profile in a photonic band gap accelerator cell in accordance with an example embodiment of the preferred invention.

The example configuration has been modeled and tested and shown improved results over the current state of the art in photonic band gap accelerators. In particular, the geometry of the first set of rods 16, second set of rods 18, and third set of rods 20 cooperates to dampen and minimize the wakefields. As shown in FIG. 2, a cell 10 with six elliptical rods in the first set of rods 16 produces a condensed electric field 40 profile about the longitudinal axis of the accelerator. As shown, the modeled electric field 40 in the example cell 10 resembles the TM01 electromagnetic field mode of a pillbox cavity. As there is little field leakage through the first set of rods 16, the energy stored in the higher order modes decays much more quickly in the example configuration than in a state of the art design using entirely round |rods|[DU1] as shown below with reference to FIGS. 3, 4, and 5(*a*), 5(*b*), and 5(*c*).

Figure 3:
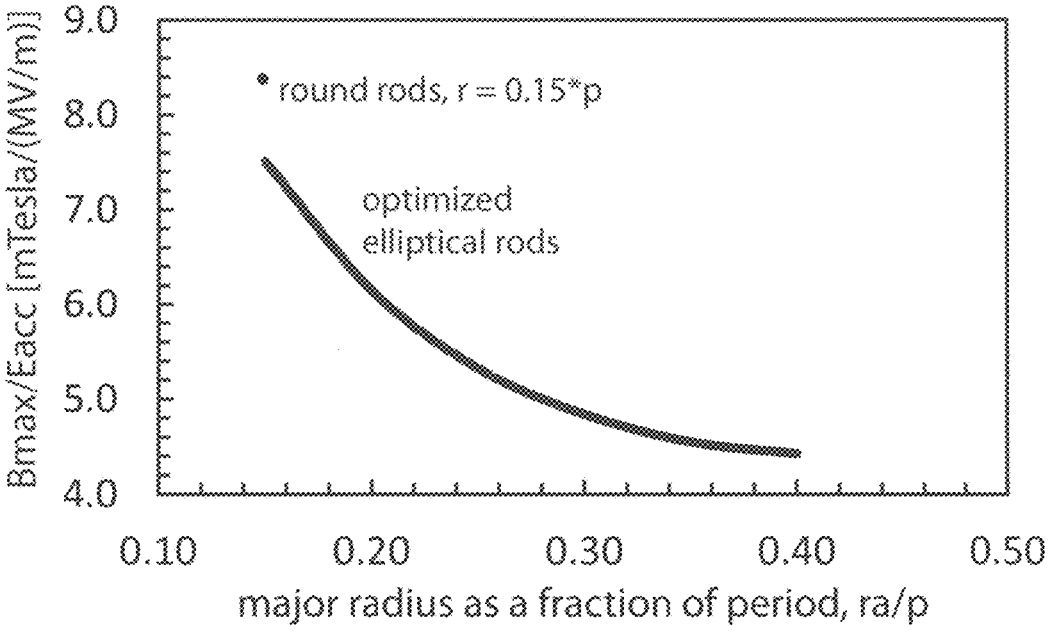
FIG. 3 is a graphical representation illustrating the relationship between a surface magnetic field and an eccentricity of a first set of rods in accordance with an example embodiment of the preferred invention.

As shown in FIG. 3, changes in the eccentricity of the first set of rods 16 can result in a reduced surface magnetic field at the first set of rods 16. In particular, FIG. 3 illustrates shows the ratio of the peak surface magnetic field Bmax (mTesla) to the accelerating gradient Eacc (MV/m) in example resonator cells with round rods and with elliptical rods as a function of the major half-axis ra as a fraction of the period p (i.e., ra/p). The ratio of the peak surface magnetic field Bmax to the accelerating gradient Eacc in the resonator cell with elliptical rods (ra/p=0.25) and round rods, is about 5.3 mTesla/(MV/m). For comparison, in the PBG resonator with only round rods (with a radius r to period p ratio of r/p=0.15) the ratio Bmax/Eacc is 8.4 mTesla/(MV/m). As shown, an optimized ratio or range of ratios between the major axis $r_a$ and the second periodicity p can result in significantly reduced surface magnetic fields, which in turn can result in improved wakefield suppression by the preferred cell 10.

Figure 4:
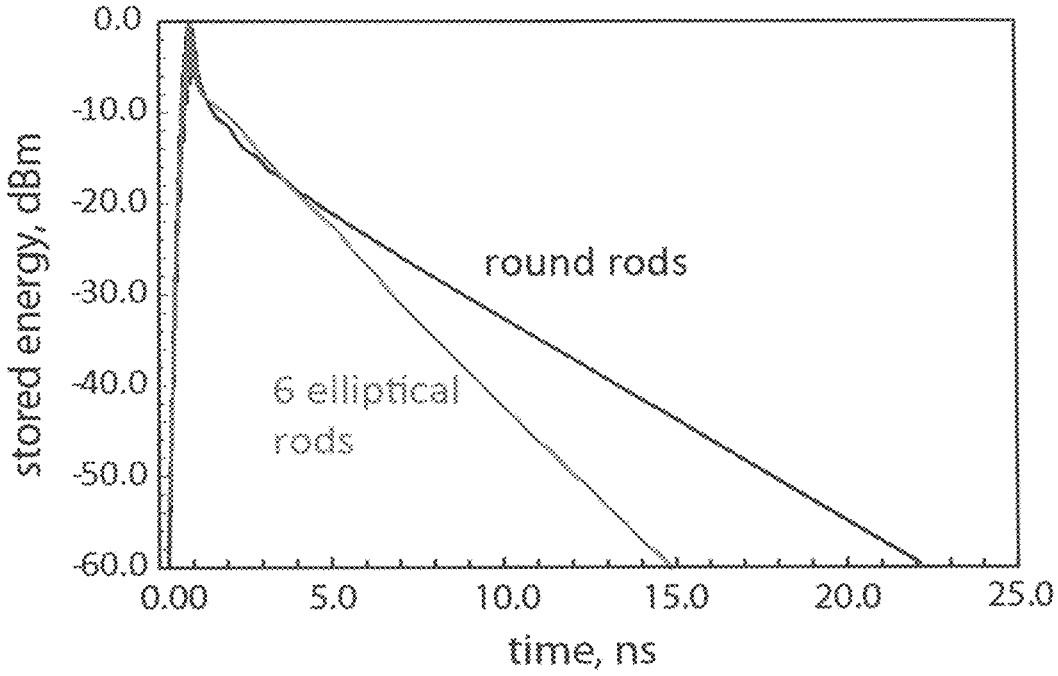
FIG. 4 is a graphical representation illustrating the Improved decay of higher order modes using the configuration of the example embodiment of the preferred invention.

As noted above, the particular geometry of the preferred cell 10 and variations thereof is optimized for the suppression of wakefields. As shown in FIG. 4, as compared to an comparative cell using round rods, the configurations of the preferred embodiments of the cell 10 described above are considerably more efficient at releasing energy stored in the HOMs. When HOMs in the frequency range of 14 to 20 GHz are considered, the diffraction Q-factor of the slowest decaying HOM is below 130.86 for embodiments of the present invention. For comparison, the diffraction Q-factor of the slowest decaying HOM in a PBG resonator with only equally spaced round rods is 212.11.

Figure 5A:
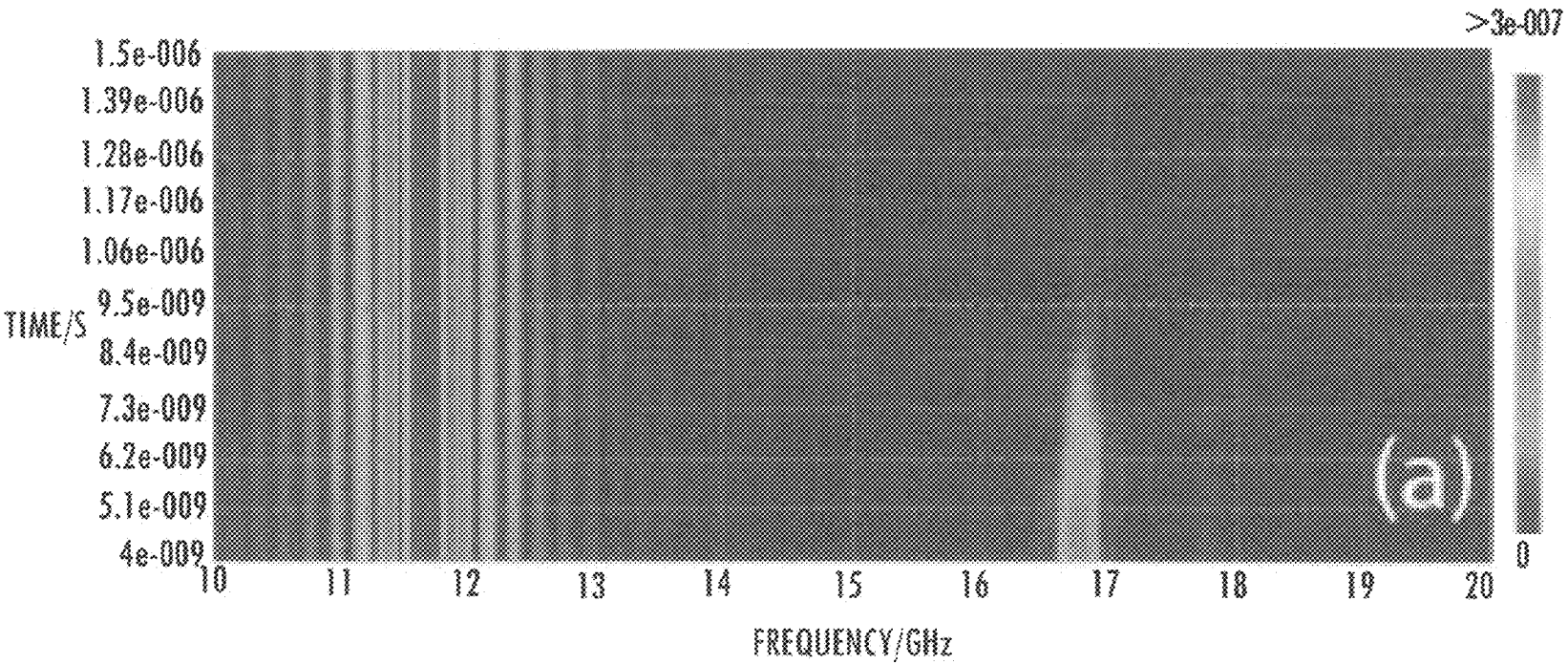
FIGS. 5A, 5B, and 5C are graphical representations of the Fourier spectra of the decay of the stored HOMs power in comparative cells according to the preferred embodiment of the present invention.
Figure 5B:
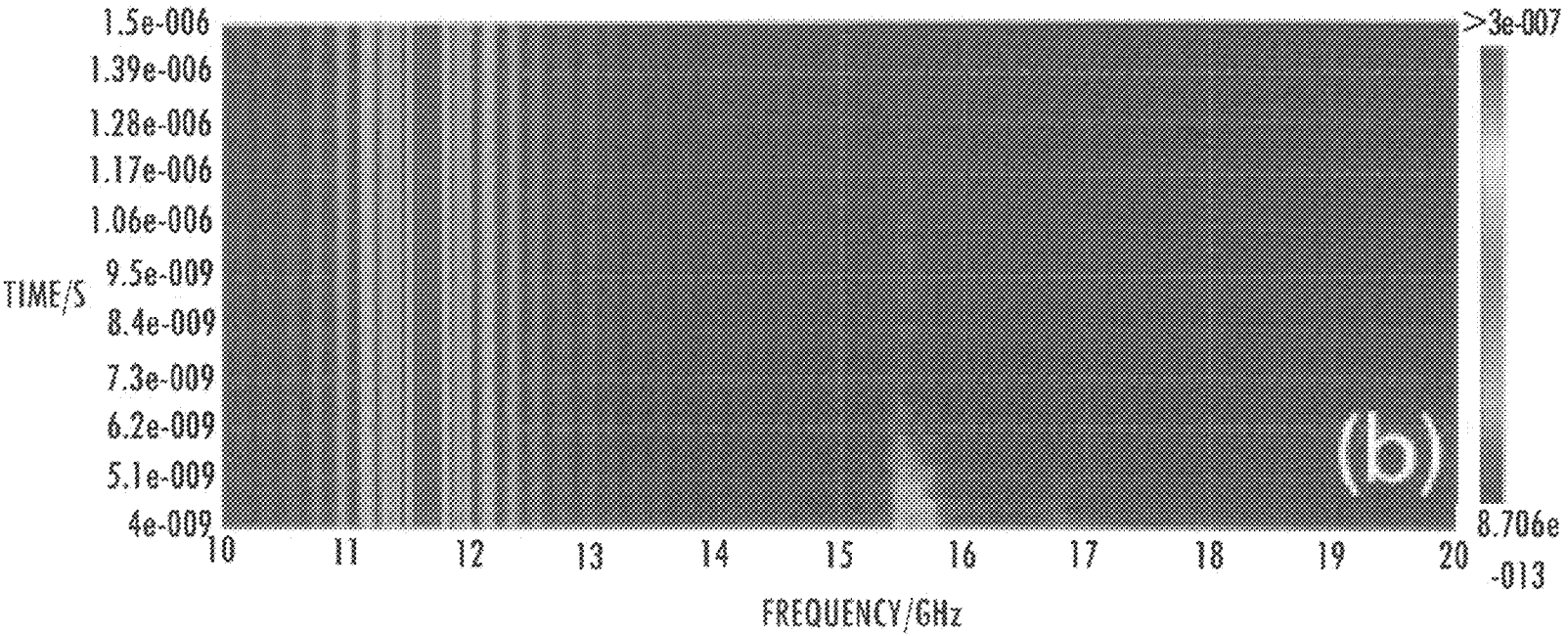
Figure 5C:
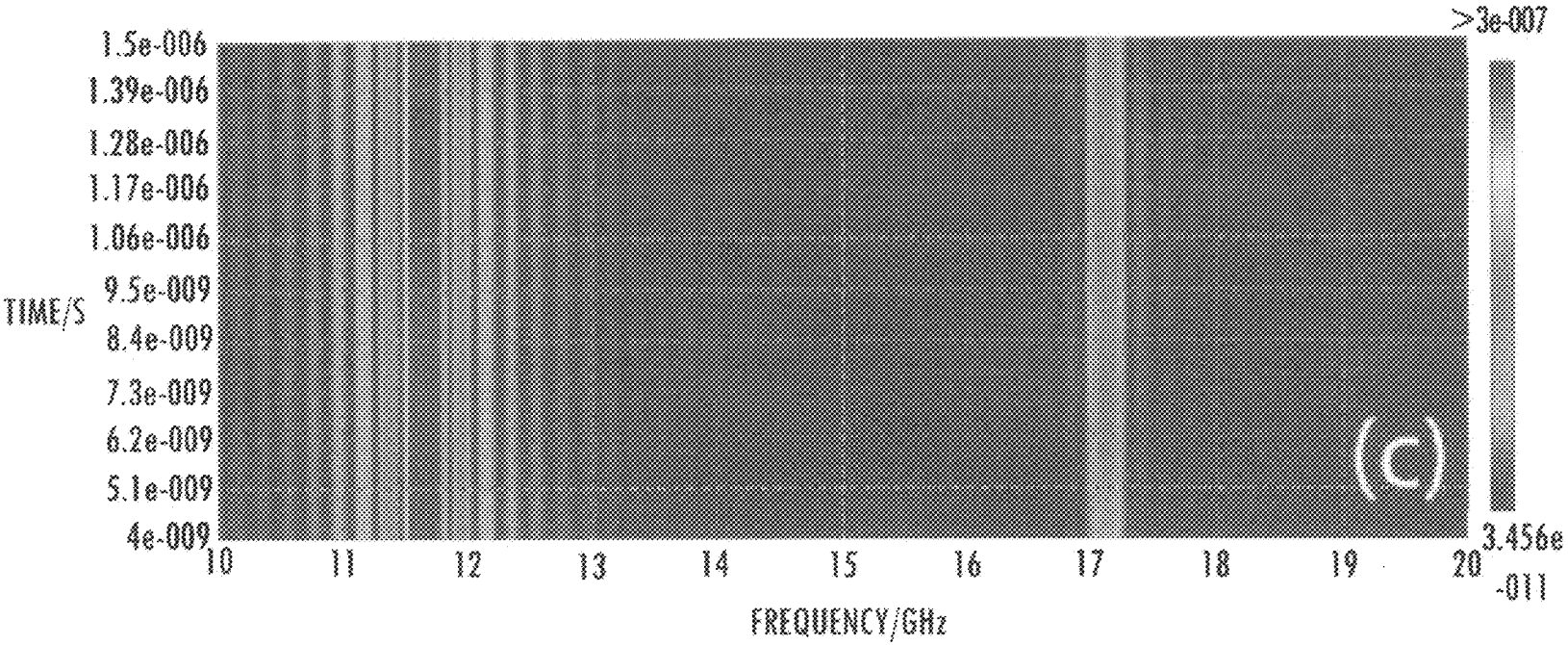

FIGS. 5(*a*), 5(*b*), and 5(*c*) are spectrograms of the Fourier spectra of the decay of the stored HOMs power in comparative cell structures. FIG. 5(*a*) is of the preferred cell 10; FIG. 5(*b*) is of a round rod convention design; and FIG. 5(*c*) is an older non-circular design using non-optimized elliptical rods. Each of the designs is scaled to an 11.7 GHz frequency. As shown, the dipole mode in the preferred cell 10 (shown in FIG. 5(*a*)) is excited with a large amplitude, but as shown in FIG. 4 it decays very quickly as compared to the round rods (shown in FIG. 5(*b*)). By way of comparison, the older elliptical design (shown in FIG. 5(*c*)) has both large amplitude excitation and slow decay times, performing worse than the round rod configuration. As such, it is an encouraging and unexpected feature of the geometry of the preferred cell 10 that an optimized geometry provides such improved wakefield suppression as compared to both the standard round rod design as well as prior attempts at elliptical rod designs.

The preferred cell 10 and variations thereof provide a versatile means to incorporate HOMs couplers into a particle accelerator. The preferred cell 10 also enables the construction of more efficient HOM couplers, thereby increasing beam breakup thresholds in high-current accelerators. In particular, the preferred cell 10 scaled to lower frequencies enables currents as high as 1 Ampere in superconducting radiofrequency accelerating structures; as compared to the current state of the art, which is below 100 milli-Amperes.

The preferred cell 10 also allows for increase of operational frequencies of superconducting radio frequency (SRF) accelerating structures from below 1.5 GHz to more than 2 GHz. Such higher frequencies make the accelerating structures more compact, thus reducing the machine's overall size (footprint) and weight, both of which translate to reduced fabrication and operation costs. The preferred cell 10 also simplifies the designs of many high-frequency SRF components, such as the linearizing cavities that operate at frequencies of 2 GHz and more. In general, the linear dimensions of the accelerator scale inversely proportional to the frequency. As the frequency goes up, the dimensions of the accelerator are reduced in size, thus an accelerator that is comprised of one or more of the preferred cells 10 that can handle higher frequencies can also be more compact and lighter, thus permitting many more uses.

Typical high frequency accelerator designs need to implement external structures or components to remove and/or dampen HOMs. Unlike current accelerator designs, the cell 10 of the preferred embodiment is designed so that the HOM coupler is part of the accelerating structure, thus eliminating the need to occupy valuable space in the beampipes. This feature simplifies the designs of the cryomodules and increases the real-estate gradient by at least thirty percent. It is important to accelerate particles to certain energy for a given application. The final energy is equal to the gradient multiplied by the length of the accelerator. If the real-estate gradient goes up, the length goes down—the smaller the length, the more compact the accelerator.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

While this invention has been described in detail with particular references to preferred and illustrative embodiments thereof, the embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims and equivalents thereof.

What is claimed is:

1. A particle accelerator cell arranged along a longitudinal axis along which a particle beam is accelerated comprising:

a first plate disposed substantially orthogonal to the longitudinal axis;

a second plate disposed substantially parallel to the first plate;

a first set of rods connecting the first plate to the second plate and disposed at a first radius about the longitudinal axis, the first set of rods each defining an elliptical cross section and a first periodicity there between, the first set of rods arranged such that a minor axis of each elliptical cross section is substantially parallel to an imaginary line emanating radially from the longitudinal axis; and a second set of rods connecting the first plate to the second plate and each disposed at least at a second radius greater than the first radius, the second set of rods each defining a circular cross section and a second periodicity there between, and wherein a ratio between the first periodicity and the second periodicity is between 0.9:1 and 1.1:1, wherein a ratio between the minor axis and the second periodicity is between 1:9 and 1:12, and further wherein a ratio between a major axis and the second periodicity is between 1:3 and 1:5.

2. The particle accelerator cell of claim 1, wherein the ratio between the first periodicity and the second periodicity is between 0.95:1 and 1.05:1.

3. The particle accelerator cell of claim 1, wherein the ratio between the first periodicity and the second periodicity is between 0.98:1 and 1:1.

4. The particle accelerator cell of claim 1, wherein the ratio between the first periodicity and the second periodicity is approximately 0.99:1.

5. The particle accelerator cell of claim 1, wherein the ratio between the minor axis and the second periodicity is approximately 1:11.

6. The particle accelerator cell of claim 1, wherein the ratio between the major axis and the second periodicity is approximately 1:4.

7. The particle accelerator cell of claim 1, wherein the ratio between the minor axis and the second periodicity is approximately 1:11 and the ratio between the major axis and the second periodicity is approximately 1:4.

8. The particle accelerator cell of claim 1, wherein a ratio between a radius of each of the second set of rods and the second periodicity is between 1:8 and 1:6.

9. The particle accelerator cell of claim 8, wherein the ratio between the radius of each of the second set of rods and the second periodicity is approximately 1:7.

10. The particle accelerator cell of claim 1, further comprising a third set of rods connecting the first plate to the second plate and each disposed at least at a third radius greater than the second radius, the third set of rods each defining a circular cross section and a third periodicity there between, and wherein a ratio between the third periodicity and the second periodicity is between 1:1 and 1.1:1.

11. The particle accelerator cell of claim 10, wherein the ratio between the third periodicity and the second periodicity is approximately 1.05:1.

12. The particle accelerator cell of claim 1, wherein a distance between the first plate and the second plate is between 8 and 9 millimeters.

13. The particle accelerator cell of claim 10, wherein the major axis of each of the first set of rods is approximately 2.58 millimeters.

14. The particle accelerator cell of claim 13, wherein the minor axis of each of the first set of rods is approximately 0.93 millimeters.

15. The particle accelerator cell of claim 14, wherein a radius of each of the second set of rods is approximately 1.55 millimeters.

16. The particle accelerator cell of claim 15, wherein the second periodicity is approximately 10.33 millimeters.

17. The particle accelerator cell of claim 16, wherein the first periodicity is approximately 10.22 millimeters.

18. The particle accelerator cell of claim 17, wherein the third periodicity is approximately 10.85 millimeters.

19. A particle accelerator comprising:

a plurality of cells arranged in series along a longitudinal axis along which a particle beam is accelerated; each of the plurality of cells comprising:

a first plate disposed substantially orthogonal to the longitudinal axis;

a second plate disposed substantially parallel to the first plate;

a first set of rods connecting the first plate to the second plate and disposed at a first radius about the longitudinal axis, the first set of rods each defining an elliptical cross section and a first periodicity there between, the first set of rods arranged such that a minor axis of each elliptical cross section is substantially parallel to an imaginary line emanating radially from the longitudinal axis;

a second set of rods connecting the first plate to the second plate and disposed at a second radius greater than the first radius, the second set of rods each defining a circular cross section and a second periodicity there between; and a third set of rods connecting the first plate to the second plate and disposed at a third radius greater than the second radius, the third set of rods each defining a circular cross section and a third periodicity there between;

wherein a ratio between the first periodicity and the second periodicity is between 0.9:1 and 1.1:1, wherein a ratio between the minor axis and the second periodicity is between 1:9 and 1:12, wherein a ratio between a major axis and the second periodicity is between 1:3 and 1:5; and wherein a ratio between the third periodicity and the second periodicity is between 1:1 and 1.1:1.

20. A particle accelerator comprising:

a plurality of cells arranged in series along a longitudinal axis along which a particle beam is accelerated; each of the plurality of cells comprising:

a first plate disposed substantially orthogonal to the longitudinal axis;

a second plate disposed substantially parallel to the first plate and approximately 8.55 millimeters therefrom along the longitudinal axis;

a first set of rods connecting the first plate to the second plate and disposed at a first radius about the longitudinal axis, the first set of rods each defining an elliptical cross section and a first periodicity there between, the first set of rods arranged such that a minor axis of each elliptical cross section is substantially parallel to an imaginary line emanating radially from the longitudinal axis;

a second set of rods connecting the first plate to the second plate and disposed at a second radius greater than the first radius, the second set of rods each defining a circular cross section and a second periodicity there between; and a third set of rods connecting the first plate to the second plate and disposed at a third radius greater than the second radius, the third set of rods each defining a circular cross section and a third periodicity there between;

wherein a ratio between the first periodicity and the second periodicity is approximately 0.99:1, wherein a ratio between the minor axis and the second periodicity is between 0.09:1, wherein a ratio between a major axis and the second periodicity is approximately 1.4; and wherein a ratio between the third periodicity and the second periodicity is approximately 1.05:1.

* * * * *